United States Patent [19]

Benaquista

[11] 4,444,306

[45] Apr. 24, 1984

[54] PALETTE BOX

[76] Inventor: Florence Benaquista, 524 Lincoln Ave., Pittsburgh, Pa. 15202

[21] Appl. No.: 455,111

[22] Filed: Jan. 3, 1983

[51] Int. Cl.[3] ..... B44D 3/00; B65D 81/24; B65D 57/00

[52] U.S. Cl. ..... 206/1.7; 206/204; 220/22

[58] Field of Search ..... 206/1.7, 1.8, 1.9, 204, 206/207; 312/31.2, 31.3; 220/22

[56] References Cited

U.S. PATENT DOCUMENTS

| | | | |
|---|---|---|---|
| 1,175,070 | 3/1916 | Maxwell | 206/1.7 |
| 1,843,514 | 2/1932 | Levy | 312/31.3 |
| 2,923,081 | 2/1960 | Simmons | 206/1.7 |
| 3,885,666 | 5/1975 | Maxwell | 206/1.7 |
| 3,885,843 | 5/1975 | Rubel | 206/1.7 |
| 3,958,715 | 5/1976 | Capelli | 220/22 |
| 4,142,627 | 3/1979 | Szegi | 206/1.7 |
| 4,368,229 | 1/1983 | Ariga | 206/459 |

*Primary Examiner*—William T. Dixson, Jr.
*Assistant Examiner*—Brenda J. Ehrhardt
*Attorney, Agent, or Firm*—William J. Ruano

[57] ABSTRACT

A rectangular box for oil painting artists for carrying and preserving left-over oil paints remaining on the palette after a painting session. The box or container has a cover with a groove along its perimeter for detachable connection with the top edge of the box to form a substantially air-tight joint. A separate compartment is provided in the box to carry a sponge so as to keep the interior moist. The separate compartment is made up of two stationary end partitions and a central partition removably fitted therein which carries a laterally extending stop to hold the palette downwardly. Another stop for this purpose is permanently attached at the other end of the box. This stop arrangement enables the use of either a rectangular or oval shaped palette.

4 Claims, 4 Drawing Figures

PALETTE BOX

This invention relates to a palette box construction and, more particularly, to one for insuring that the palette is held downwardly at all times irrespective of the position that the box is carried.

An outstanding disadvantage of presently used palette boxes is that their top construction include projections which dig into leftover paint on the palette, therefore wasting paint as well as smearing and requiring cleaning of such projections.

An object of the invention is to overcome the above-named disadvantages.

A more specific object of the invention is to provide a palette box enabling the carrying and firm support of either a rectangular or oval shaped palette.

Still another object of the invention is to provide a novel assembly for a palette box to insure a moist atmosphere to prevent drying out of leftover paint on the palette.

Other objects and advantages of the invention will become more apparent from a study of the following description taken with the accompanying drawing wherein.

Figure 1:
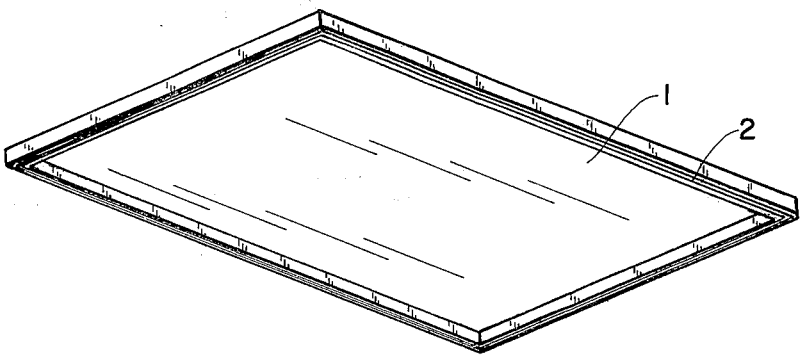
FIGS. 1 and 2 show a perspective, exploded view of a palette box embodying the present invention.
Figure 2:
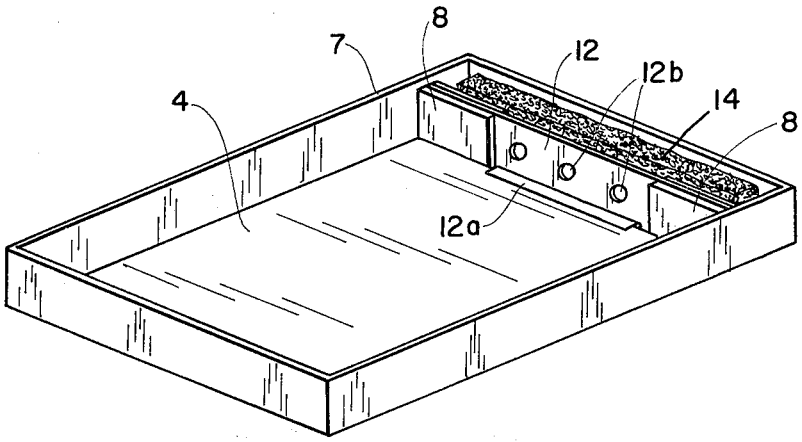
Figure 3:
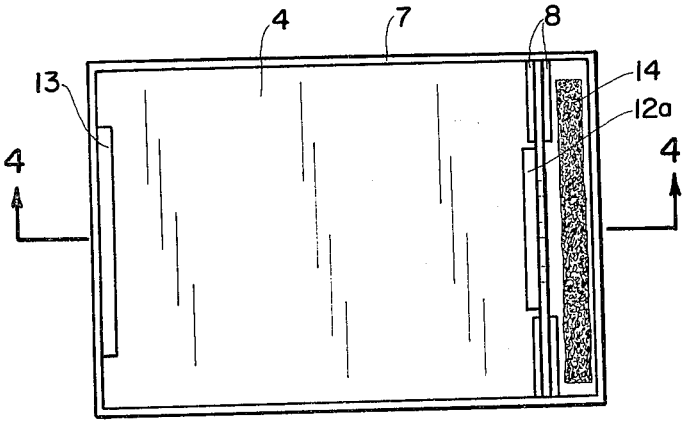
FIG. 3 is a top view of the box without the cover.
Figure 4:
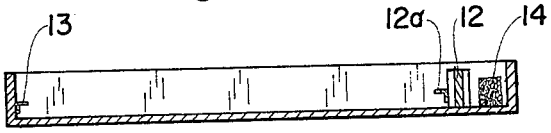
FIG. 4 is a cross-sectional view taken along line 4—4 of FIG. 3.

Referring more particularly to FIGS. 1 and 2, numeral 1 denotes a cover for the palette box having, along its perimeter, a locking channel 2 which is slightly wider and longer than the bottom 4 of the container for interlocking engagement of the locking channel 2 of the cover to a bead 7 of the container to form a substantially air-tight fit so as to preserve oils and mixtures remaining on the palette after the artist is finished painting.

A separate compartment is provided in the container formed by short, stationary partitions 8,8 having ends rigidly attached to opposite sides of the box near one end thereof and including a separate, removable bridging element 12 which has end portions which fit into central slots formed in the partition elements 8,8. The central portion of the bridging element 12 is provided with a horizontally extending flange **12*a* which contacts the top surface at the end portion of the palette (not shown) for keeping the palette down and prevent it from moving towards the top of the container. A similar horizontally extending projection or stop 13 is provided at the opposite end of the box and rigidly secured thereto for holding down the other end of the palette. Since the horizontal flanges or stops 12 and 13** extend only along an intermediate portion, they are adapted to hold down either a palette of rectangular shape or one of oval shape.

To keep the inside of the box moist, a sponge 14 is wet and then inserted in the end compartment for the purpose of keeping the paints remaining on the palette sufficiently moist as to be readily usable again. The height of the partitions 8,8 which is less than that of the box and bridging element 12 enable moisture to flow above their top ends and over the palette. Holes **12*b* may be provided in the bridging element 12** to help in allowing moist air emanating from the sponge to flow over the palette.

Thus it will be seen that I have provided a highly efficient and reliable palette box which is not only substantially air-tight but which has means for firmly holding the palette against the bottom portion of a box without smearing the paint on the palette; also I have provided a removable bridging element or partition to enable when removed, grasping of the palette with the fingers by projecting them into the end compartment space for lifting the palette when required for painting.

While I have illustrated and described a single specific embdiment of my invention, it will be understood that this is by way of illustration only and that various changes and modifications may be contemplated in my invention which are within the scope of the following claims.

I claim:

1. An artist's palette box of rectangular outline including a readily detachable lid forming a substantially airtight fit of the box, a partition extending across the portion of the box of smaller width and near the end of said box to form a narrow compartment, said partition including a readily removable central portion, and stop means extending laterally of said central portion to hold down the top surface of a palette placed in said box.

2. A palette box as recited in claim 1 wherein a sponge is contained in said narrow compartment and wherein said central portion has holes to allow moisture from said sponge, when wet, to travel to the main portion of said box to keep the aplette moist.

3. A palette box as recited in claim 1 together with a second stop extending laterally of the end of the palette containing portion of said box in confronting relationship with said first stop to hold down the opposite end of said top surface of the palette.

4. A palette box as recited in claim 1 wherein said partition comprises end portions rigidly secured to the inside surfaces of said box, vertical slots formed in said end portions into which adjoining integral portions of said central portion exted to provide ready removability of said central portion.

* * * * *